US005776019A

United States Patent [19]

Kronenberger

[11] Patent Number: 5,776,019

[45] Date of Patent: Jul. 7, 1998

[54] GOALKEEPING APPARATUS

[76] Inventor: Ronald Kronenberger, 320 Portwine Rd., Riverwood, Ill. 60015

[21] Appl. No.: 610,367

[22] Filed: Mar. 4, 1996

Related U.S. Application Data

[63] Continuation-in-part of Ser. No. 249,548, May 26, 1994, abandoned.

[51] Int. Cl.[6] ..... A63B 69/40

[52] U.S. Cl. ..... 473/446; 273/354; 273/370; 473/471; 473/478

[58] Field of Search ..... 273/108.1, 348, 273/354, 359, 369, 370; 473/422, 446, 471, 476, 478

[56] References Cited

U.S. PATENT DOCUMENTS

| | | | |
|---|---|---|---|
| 3,765,675 | 10/1973 | DiMarzio | 473/446 |
| 4,168,062 | 9/1979 | McCarthy et al. | 473/446 |
| 5,498,000 | 3/1996 | Cuneo | 473/446 |
| 5,509,650 | 4/1996 | MacDonald | 473/446 |

*Primary Examiner*—William M. Pierce

*Attorney, Agent, or Firm*—Wood, Phillips, VanSanten, Clark & Mortimer

[57] ABSTRACT

A combination including a frame defining at least one of a hockey and a soccer goal, a blocking element, and first structure for moving the blocking element in front of the frame so as to expose and block different parts of the goal as the blocking element is moved. The first structure moves the blocking element in two different manners in front of, and relative to, the frame.

17 Claims, 5 Drawing Sheets

GOALKEEPING APPARATUS

CROSS-REFERENCE

This application is a continuation-in-part of application Ser. No. 08/249,548 filed May 26, 1994, entitled "Goalkeeping Apparatus" now abandoned.

BACKGROUND OF THE INVENTION

1. Field of the Invention

This invention relates to sports, such as hockey and soccer, that utilize a goal and goalkeeper ("goalie") and, more particularly, to an animated apparatus to simulate a live goalkeeper.

2. Background Art

The game of hockey continues to be popular worldwide. Hockey is played on a number of different surfaces. Most commonly, hockey is played on ice.

Many cities and towns do not build and maintain ice arenas for hockey playing. High quality ice surfaces require ongoing upkeep and maintenance, which involves a considerable expense. In certain locales, it is impractical to maintain ice in an arena on a year round basis. It may be prohibitive to control the interior climate to maintain high quality ice in a large arena during summer months. In some warmer geographic regions, it is impractical to even open such an arena. This has lead to the playing of hockey outdoors on concrete and asphalt surfaces, such as in streets and playgrounds.

Outdoor hockey has become increasingly popular with the recent developments in rollerblade technology. The use of "high tech" rollerblades on concrete or asphalt surfaces gives the player a sensation very similar to that experienced when playing on ice.

A critical position in hockey, regardless of where it is played, is the goalkeeper ("goalie"). This is to many recreational players the least desirable position to play in a hockey game in that it can be stress-filled and at times dangerous, particularly when adequate protective gear is not worn.

To be properly protected, the goalkeeper is clad from head to toe with a combination helmet/mask, padding for the torso and arms, specially designed gloves for holding a stick and catching, and large shin pads.

In warm conditions, a fully clad goalie may experience suffocating heat. However, regardless of the temperature, the goalie position is undesirable from the standpoint of the considerable expense involved in purchasing equipment. A full ensemble of goalie equipment may cost in excess of $2,000.

Because of the above problems, it is often difficult to find anyone willing to play the goalie position in other than organized leagues. As a result, individuals can be seen playing hockey games without any goalie. Alternatively, people may choose to play goalie with less than adequate equipment, i.e. normal equipment used by players at other positions. Often the rules of play are modified to prevent injuries to such individuals. For example, slap shots and other lifted shots may be prohibited to avoid injury to the goalie. As a consequence, enjoyment may be compromised for the sake of safety. Regardless of the care exercised, injury to such an inadequately protected individual commonly results.

SUMMARY OF THE INVENTION

In one form of the invention, a combination is provided including a frame defining at least one of a hockey and a soccer goal, a blocking element, and first structure for moving the blocking element in front of the frame so as to expose and block different parts of the goal as the blocking element is moved. The first structure moves the blocking element in two different manners in front of, and relative to, the frame.

In one form, the first structure cooperates between the blocking element and frame for guiding the blocking element in movement relative to the frame. Alteratively, with the frame supported on a subjacent surface, the first structure cooperates between the blocking element and subjacent surface for guiding the blocking element in movement relative to the frame.

The first structure may move the blocking element pivotably about a vertically extending axis relative to the frame. Part of the, or the entire, blocking element may be pivoted about this vertically extending axis.

In one form, the frame has a lateral extent and the first structure moves the blocking element laterally relative to the frame. This may be done in a straight or an arcuate path.

The first structure may move the blocking element in a fore and aft direction relative to the frame.

In one form, the blocking element has first and second parts that are movable relative to each other as the blocking element moves in front of the frame.

The first structure may move the blocking element in a random fashion in front of the frame.

There may be second structure for operating the first structure from a location remote from the blocking element and frame.

In one form, the second structure includes a transmitter for sending a control signal, with the first structure having a receiver for the control signal and being operable in response to a signal being sent by the transmitter to the receiver.

The signal may be a radio signal or another type of signal that can be sent without hard connection between the transmitter and the receiver. Alternatively, a hard connection can transmit the signal between the transmitter and receiver.

The frame may be provided on an ice rink. The transmitter can be operated from a location spaced from the ice rink.

The actuator that responds to the control signal may relatively move different parts of the blocking element.

In another combination according to the invention, a frame is provided for defining at least one of a hockey and a soccer goal, together with a blocking element and first structure for moving the blocking element in front of the frame so as to expose and block different parts of the goal as the blocking element is moved. The first structure may include a) a first actuator and structure cooperating between the first actuator and blocking element for moving at least a part of the blocking element as the first actuator is operated and b) a second actuator and structure cooperating between the second actuator and blocking element for moving at least a part of the blocking element as the second actuator is operated.

In one form, the first and second actuators independently move at least a part of the blocking element.

DETAILED DESCRIPTION OF THE DRAWINGS

Figure 1:
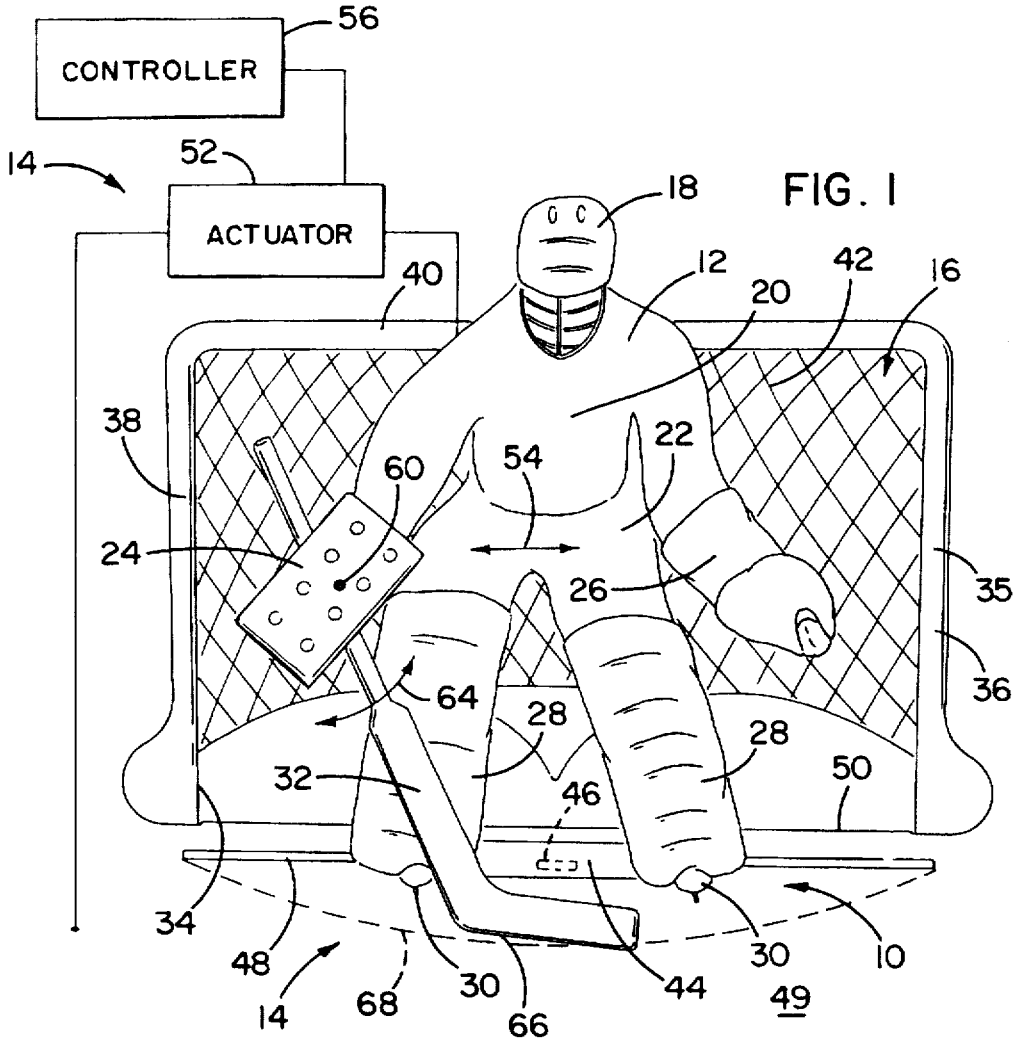
FIG. 1 is a front elevation view of a hockey goal with a goalkeeping apparatus, according to the present invention, associated therewith.

In FIG. 1, one form of goalkeeping apparatus, according to the present invention, is shown at 10. The goalkeeping apparatus 10 includes a blocking element 12 and means at 14 for moving the blocking element in front of a goal 16 so as to selectively expose and block different parts of the goal 16 as the blocking element 12 is moved in front thereof.

The blocking element 12 is constructed to simulate a "live" goaltender/goalie. That is, the blocking element 12 is constructed substantially in the shape of an actual player having a full array of protective equipment and in an actual game stance. The size of the blocking element 12 corresponds to the size of an average person that would play that position.

The blocking element 12 can be made from a flat piece of material (see FIGS. 4 and 5) or in three dimensions in the shape of an actual player. To give it a lifelike appearance, the three dimensional blocking element 12 can be dressed in full goalie equipment, to include a helmet 18, a chest protector 20, padded pants 22, a stick glove 24, a catch glove 26, leg pads 28, skates 30, and a stick 32.

According to the invention, the blocking element 12 is moved in front of the goal 16 to provide an obstruction to the goal opening 34 to simulate a "live" goalie. The goal 16 can be a conventional goal with a frame 35 having standard dimensions, including laterally spaced upright bars 36, 38 and a horizontal cross bar 40 to which a net 42 is attached.

In FIG. 1, the blocking element 12 is carried by a slider 44. The slider 44 includes an element 46 that moves guidingly in an elongate slot 48 in the subjacent ice surface 49 extending across the width of the goal 16 in front of the goal line 50.

An actuator 52 is operated to move the blocking element 12 laterally back and forth in front of the goal 16, as indicated by the double-headed arrow 54. A controller 56 is provided to operate the actuator 52. The width of the path and speed of movement can be varied by the controller 56. The controller 56 may cause the actuator 52 to operate continuously or intermittently.

The controller 56 may be programmable, in which event movement of the blocking element 12 can be made random. As a result, players cannot anticipate movement of the blocking element 12 as might make it easier to score a goal.

To prevent hangup between the stick 32 and the subjacent surface 49 as the blocking element 12 is moved, the stick 32 can be pivotably mounted to the stick glove 24 by a pin 60. The stick 32 is thus allowed to float, as indicated by the double-headed arrow 64, so that the heel 66 of the stick 32 at all times flushly contacts the surface 58 as the blocking element 12 moves.

A guide slot 68 for the slider 44 can be arranged in an arcuate path in front of the goal 16 as an alternative to the straight path described above.

Figure 2:
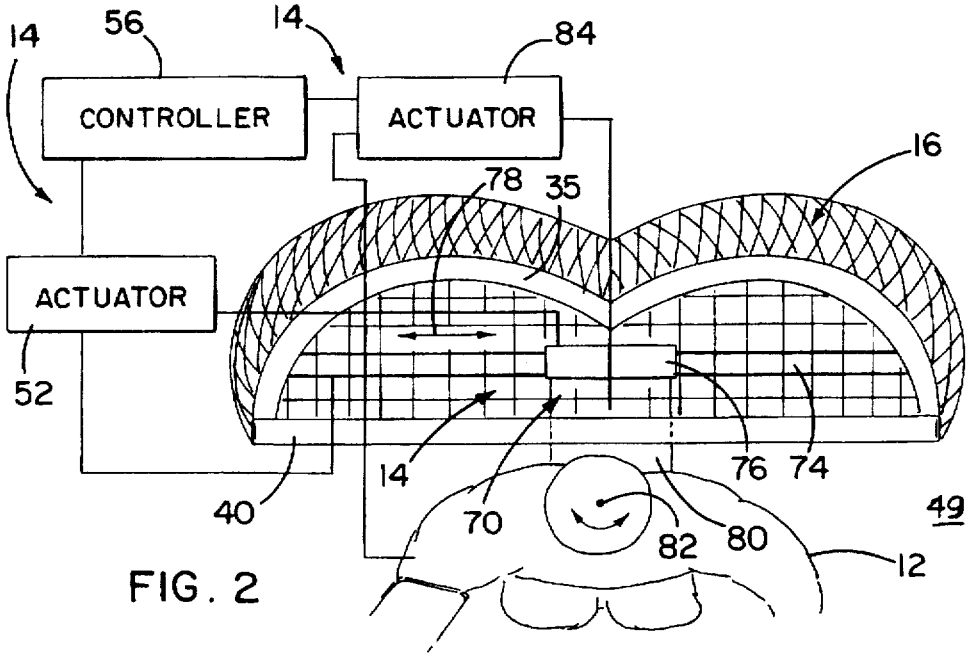
FIG. 2 is a plan view of a modified form of goalkeeping apparatus according to the invention.

In FIG. 2, the means for moving the blocking element 12 is modified from the means 14 in FIG. 1 so that movement of the blocking element 12 is guided through a frame 70 associated with the goal frame 35. More particularly, a horizontally extending guide rail 74 is integrated into the goal frame 35. The guide rail 74 is slightly rearwardly recessed from the cross bar 40 and at any desired height between the cross bar 40 and the surface 49.

The frame 70 includes a guide sleeve 76 which surrounds the guide rail 74 and is movable guidingly therealong in the direction of the double-headed arrow 78. The guide rail 76 is connected to the blocking element 12 through a mounting block 80.

The basic operation of the blocking element 12 in FIG. 2 is similar to that described with respect to FIG. 1. That is, the controller 56 effects operation of the actuator 52 which causes movement of the blocking element 12 back and forth in front of the goal 16.

To add another dimension of movement to the blocking element 12, the blocking element 12 can be connected to the block 80 by a pin 82 for pivoting movement about a vertically extending axis relative to the block 80 and the frame 35. A separate actuator 84 can be provided to pivot the blocking element 12 about the pin 82. As the blocking element 12 moves from side to side, the controller 56 can operate the actuator 84 to thereby cause the blocking element 12 to pivot about a vertical axis randomly or in a prescribed pattern.

Figure 3:
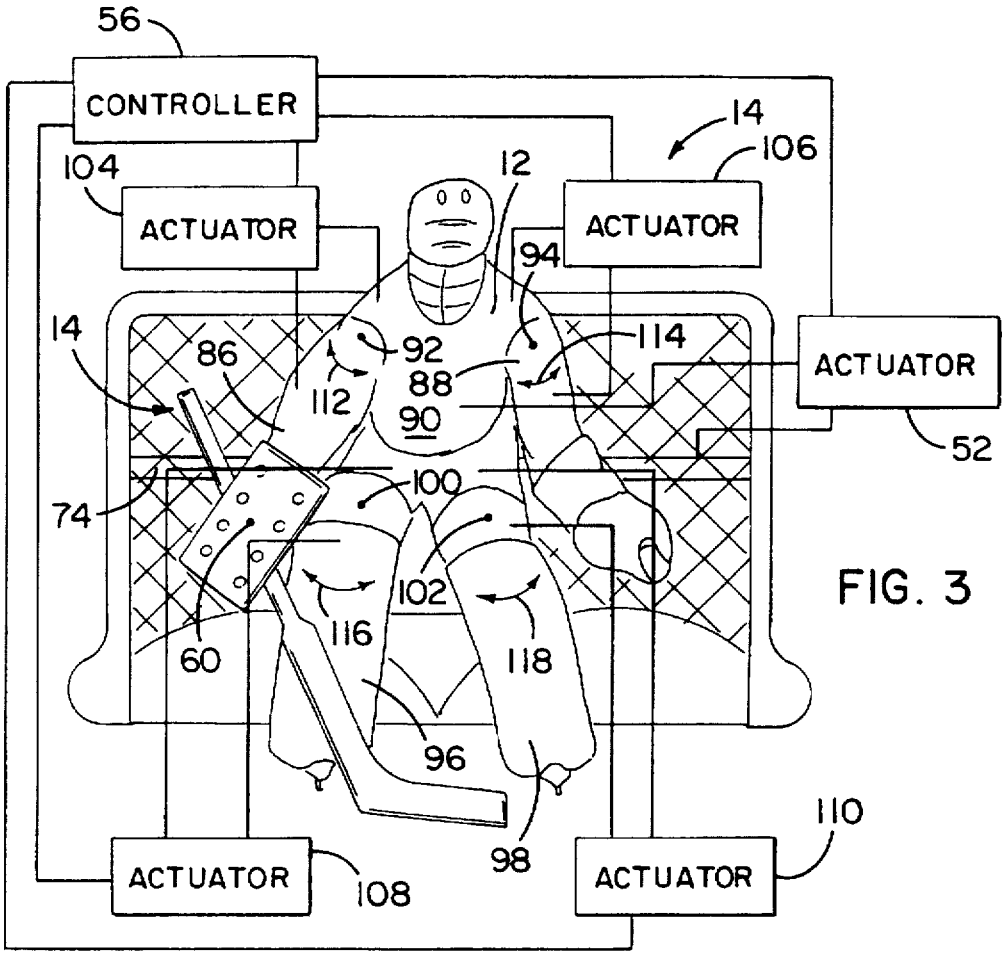
FIG. 3 is a front elevation view of a further modified form of goalkeeping apparatus according to the invention.

In FIG. 3, a more sophisticated version of the inventive structure is shown. In this version, the blocking element 12 has arms 86, 88 which are movably connected to the torso 90 through pins 92, 94. The legs 96, 98 on the blocking element are likewise movably connected to the torso 90 through pins 100, 102. In this case, the controller 56, in addition to operating the actuator 52 to effect lateral movement of the blocking element 12 along the guide bar 74, operates four additional actuators 104, 106, 108, 110, which pivot the arms 86, 88 and legs 96, 98. More particularly, the actuator 104 is operated to pivot the arm 86 about the pin 92, as indicated by the double-headed arrow 112. The actuator 106 similarly moves the arm 88 about the pin 94, as indicated by the double-headed arrow 114. The actuators 108, 110 cause movement of the legs 96, 98 about the pins 100, 102, as indicated by the double-headed arrows 116, 118.

With the arrangement shown in FIG. 3, the controller 56 can be operated to reconfigure the blocking element 12 to make the blocking element 12 more lifelike and a more formidable obstruction in front of the goal 16.

Figure 4:
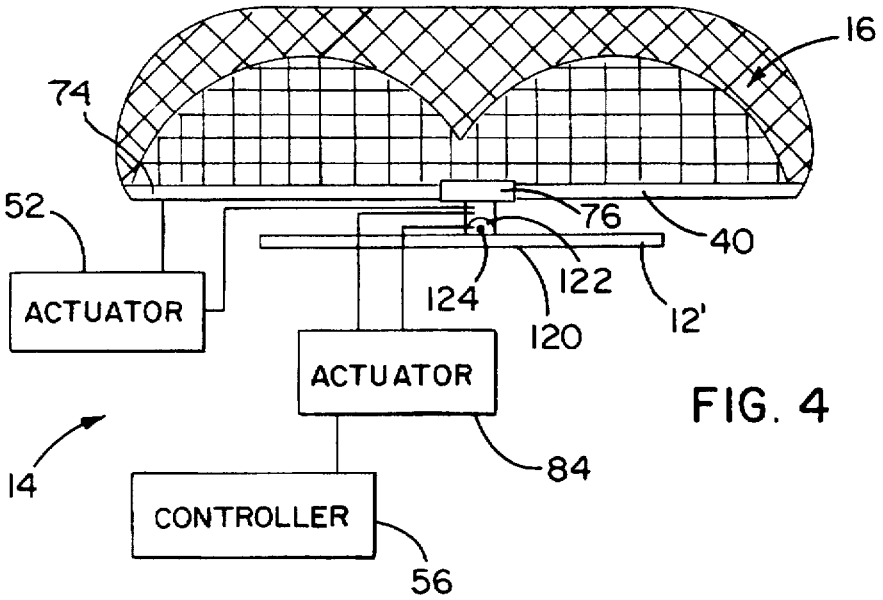
FIG. 4 is a plan view of a still further modified form of goalkeeping apparatus according to the present invention.
Figure 5:
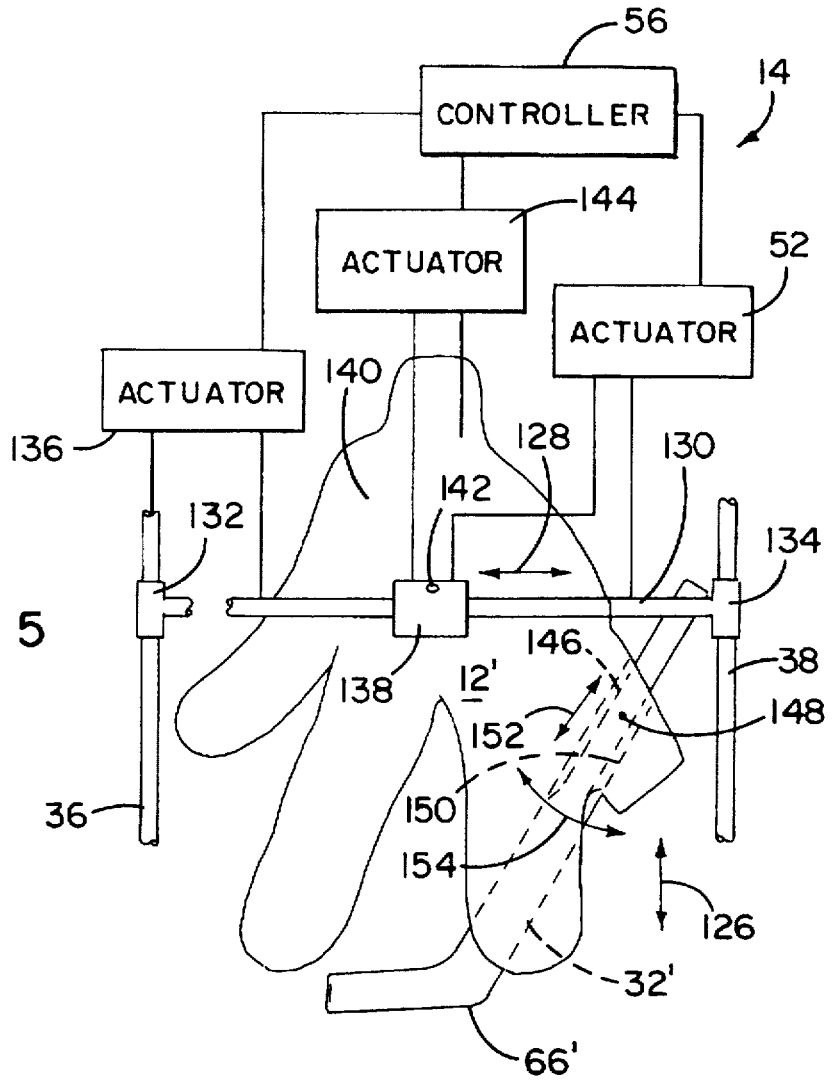
FIG. 5 is a rear elevation view of a blocking element on the goalkeeping apparatus in FIG. 4.

In FIGS. 4 and 5, a modified form of blocking element 12' is shown to have a substantially flat construction. The front surface 120 of the blocking element 12' can be configured and painted to have the appearance of a live player in full equipment as viewed from the front of the goal 16.

The blocking element 12' has an associated bracket 122 which can be attached to the guide sleeve 76 which in turn moves along the cross bar 40 or a guide rail 74, incorporated into the goal 16 as previously described. In this case, a vertically extending pin 124 effects connection between the bracket 122 and guide sleeve 76 to allow the blocking element 12' to pivot about a vertically extending axis.

The controller 56 operates the actuators 52, 84, which respectively effect lateral translatory movement of the blocking element 12' in a first path and pivoting movement thereof in a second path.

In FIG. 5, a modified form of means 14 is shown. In this form, the blocking element 12' is movable vertically in a third path, as indicated by the double-headed arrow 126, as well as horizontally in the first part, as indicated by the double-headed arrow 128.

More particularly, a horizontally extending guide rail 130 is provided and has at its ends guide sleeves 132, 134 which surround and guide vertical movement of the guide rail 90 relative to the upright posts 36, 38. This movement is effected through an actuator 136.

The previously described actuator 52 effects lateral movement of the blocking element 12'. In this case, a mounting block 138 is operatively connected to the guide rail 130 for movement laterally therealong. The guide block 138 is connected to the back surface 140 of the blocking element 12' through a pin 142. This arrangement allows the blocking element 12' to pivot relative to the mounting block 138 about a fore and aft axis defined by the pin 142. A separate actuator 144 can be provided to effect controlled pivoting movement of the blocking element 12' about the pin 142.

With this arrangement, the blocking element 12' can be raised, lowered, shifted laterally, and pivoted about the pin 142 to allow relatively complex movement, as dictated by the controller 56.

To accommodate these various movements, a movable stick 32' can be attached to the remainder of the blocking element 12'. More particularly, the stick 32' can be connected to a guide rail 146 through a pin 148 extending in a fore and aft direction. The guide rail 146 in turn is guided within a slot 150 which allows the stick 32' to move in the direction of the double-headed arrow 152 as well as pivot as indicated by the double-headed arrow 154. With this arrangement, as the blocking element 12' raises and pivots about the pin 142, the heel 66' of the stick 32' remains flushly against the subjacent surface.

Figure 6:
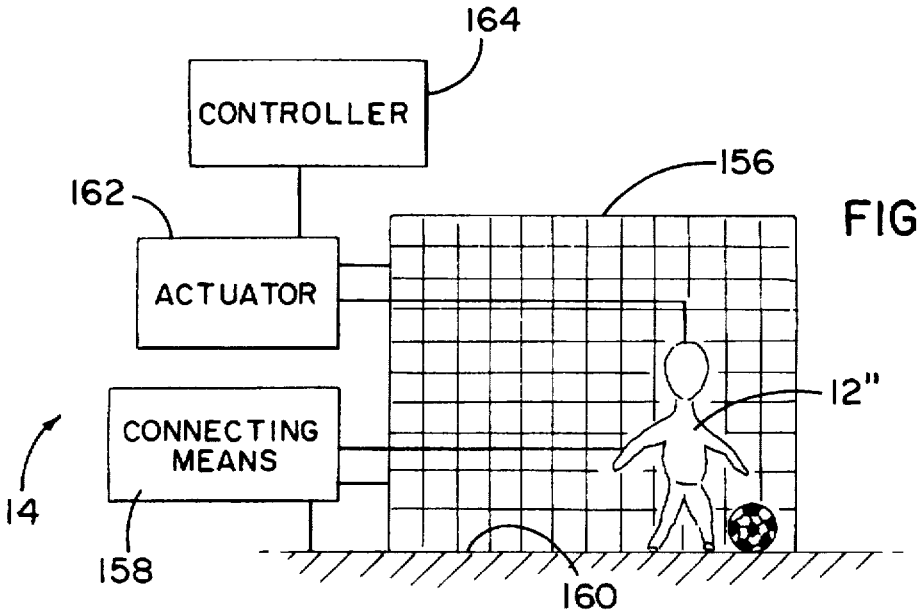
FIG. 6 is a schematic, front elevation view of a soccer goal with a blocking element according to the present invention associated therewith.

In FIG. 6, a blocking element 12" is shown in relationship to a soccer goal 156. The blocking element 12" is movably connected by a means 158 to one of the goal 156 and surface 160 for guided movement relative thereto. An actuator 162 effects movement of the blocking element 12" and is operated through a controller 164.

The connecting means 158, actuator 162, and controller 164 cooperatively define a means 14 for moving the blocking element 12" and can be constructed as the means 14 previously described with respect to FIGS. 1–5.

Figure 7:
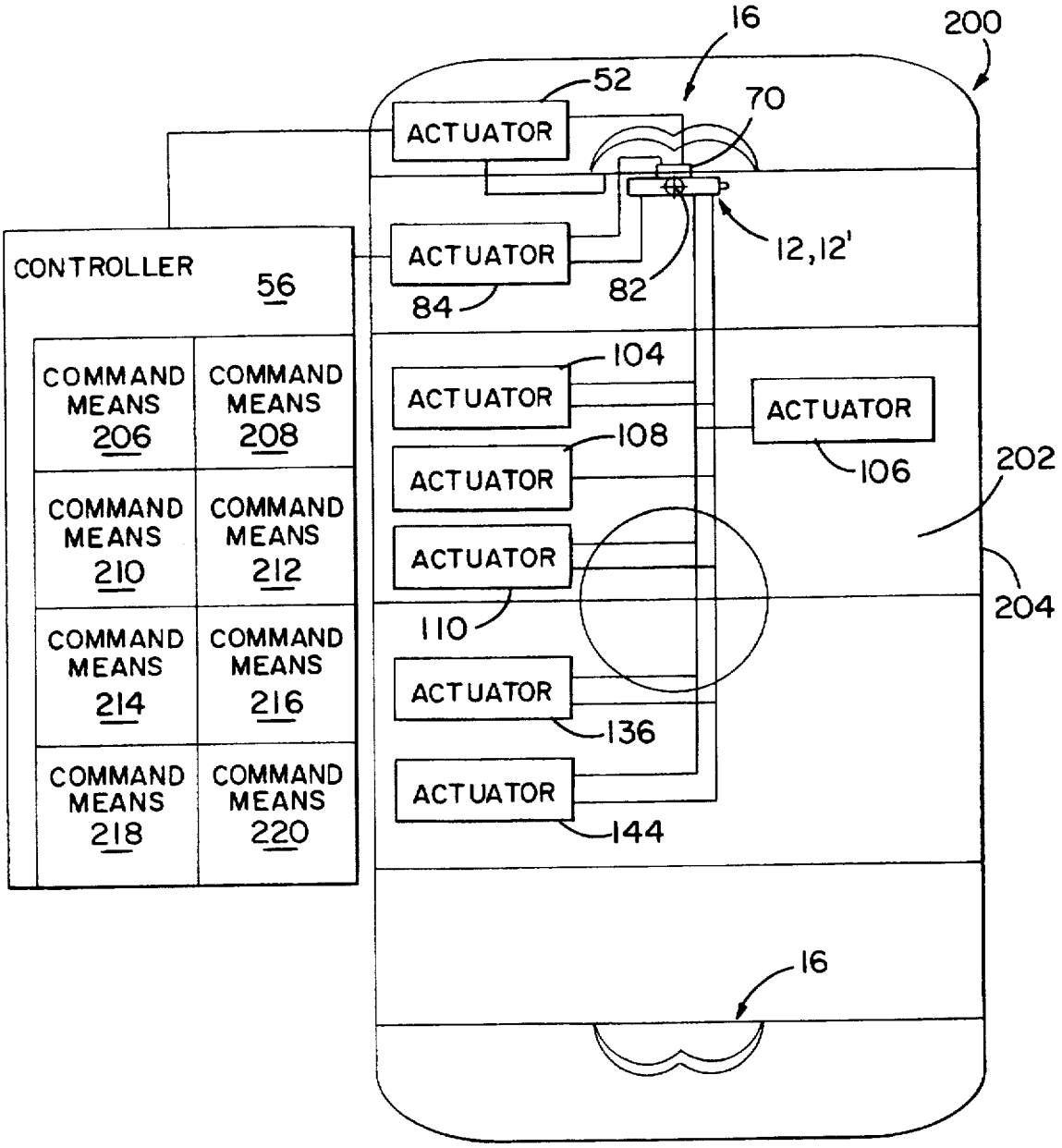
FIG. 7 is a schematic, plan view of a rink with a goal and a goalkeeping apparatus, according to the present invention, thereon, and with a controller therefor situated remotely from the goalkeeping apparatus.

In FIG. 7, a conventional hockey rink is shown at 200, to include an ice surface 202 and a peripheral wall 204 projecting upwardly therefrom, and conventionally described as "boards".

Two goals 16 are shown, with one of the goals having the inventive blocking element 12, 12' associated therewith. The blocking element 12, 12' is operatively connected to actuators 52, 84, 104, 106, 108, 110, 136, 144, the same as those described previously. According to this embodiment, the controller 56 is located remotely from the goal 16 and the blocking element 12.

In a preferred form, the controller 56 is located fully outside of the rink 200 so as to be operable by a user in the position of a spectator. The controller 56 can be provided with individual command means 206, 208, 210, 212, 214, 216, 218, 220 which direct a signal to the actuators 52, 84, 104, 106, 108, 110, 136, 144, consecutively, to control movement of the blocking element 12 in the same manner as previously described. The command means 206, 208, 210, 212, 214, 216, 218, 220 can include push pads, switches, or a "joy stick" to effect the desired movement through the actuators 52, 84, 104, 106, 108, 110, 136, 144.

With the arrangement in FIG. 7, the operator of the controller 56 can become part of a game without physically being present on the ice surface 202. Alternatively, the operator of the controller 56 can be situated several feet away from the blocking element 12 and goal 16 and on the ice surface 202.

In one preferred from, the controller 56 controls the actuators 52, 84, 104, 106, 108, 110, 136, 144 without a hard/wire connection therebetween. In one example, an RF signal is generated by the controller 56 to operate the actuators 52, 84, 104, 106, 108, 110, 136, 144, which have an appropriate receiver and response circuit.

In another form of the invention, the controller 56 is voice actuated. The basic technology to accomplish this is well known, as shown, for example, in U.S. Pat. No. 4,725,956, to Jenldns, which is incorporated herein by reference.

The invention nonetheless contemplates that the controller 56 can communicate with the actuators 52, 84, 104, 106, 108, 110, 136, 144 through wiring that can be directed under the ice surface 202 so as not to interfere with play. This allows control of the actuators 52, 84, 104, 106, 108, 110, 136, 144 from a remote location, such as off of the ice surface 202 or merely several feet away from the actuators 52, 84, 104, 106, 108, 110, 136, 144.

Figure 8:
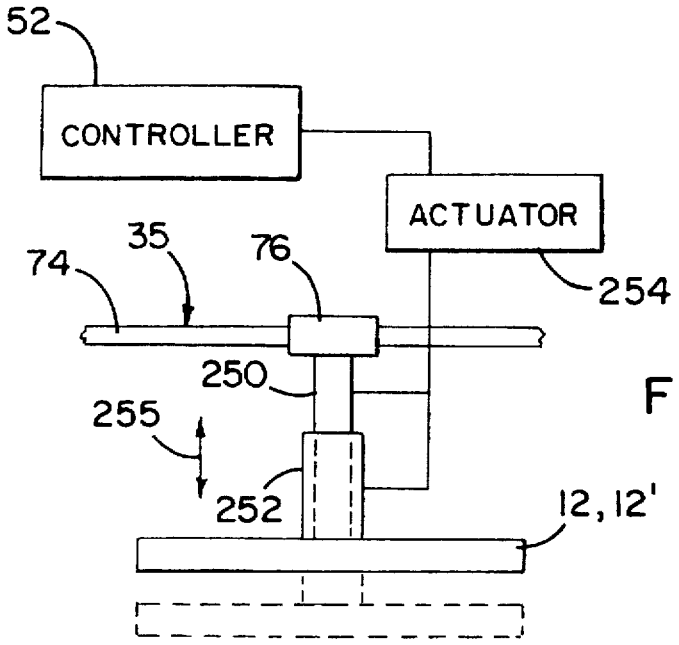
FIG. 8 is a fragmentary, plan view of a modified form of goalkeeping apparatus according to the present invention.
Figure 9:
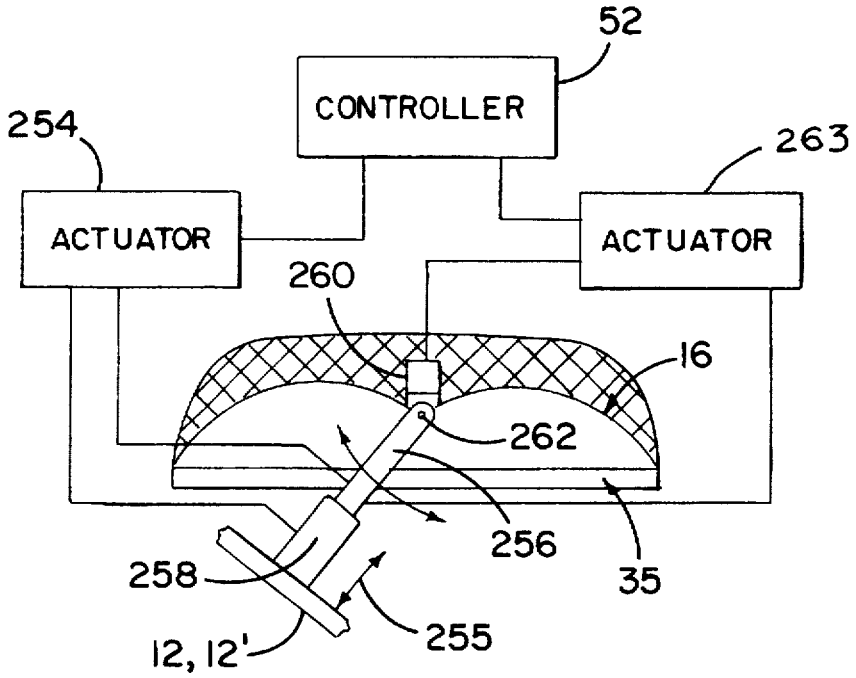
FIG. 9 is a plan view of a still further modified form of goalkeeping apparatus according to the present invention.

In FIGS. 8 and 9, variations of the means for controlling movement of the blocking element 12, 12' are shown. In FIG. 8, the blocking element 12, 12' is connected to a guide sleeve 76 and a guide rail 74 as in the embodiment in FIG. 2. Telescoping rods 250, 252 connect between the guide sleeve 76 and the blocking element 12, 12'. The rods 250, 252 are movable one within the other to thereby move the blocking element 12, 12' in a fore and aft direction relative to the frame 35. The controller 52 selectively operates an actuator 254, which repositions the rods 250, 252 to move the blocking element 12, 12' in the line of the double-headed arrow 255.

In FIG. 9, telescoping rods 256, 258 are provided to connect between the blocking element 12, 12' and a support block 260 on the frame 35. Through the rods 256, 258, the blocking element 12, 12' is movable, via the actuator 254, in a fore and aft direction, as indicated by the arrow 255. The rod 256 has its end connected to the block 260 through a pin 262 that defines a vertically extending pivot axis for the rod 256. With this arrangement, the blocking element 12, 12' is movable in an arcuate path relative to the frame 35 at the front thereof.

The invention contemplates using any and all combinations of pivoting and translatory movement, both laterally and in a fore and aft direction, for the blocking element 12, 12', 12". By moving the blocking element in each of these manners, a different dimension can be added to the blocking element 12, 12', 12". This action is improved even further by the relative movement of the individual parts of the blocking element 12. Still further, the ability to individually control all manners of movement of the parts of the blocking element 12 and the blocking element 12, 12', 12" as a whole, makes the inventive device highly versatile.

While hockey and soccer games are described above, the inventive concept can be practiced with any game using a goal and goalkeeper.

The foregoing disclosure of specific embodiments is intended to be illustrative of the broad concepts comprehended by the invention.

I claim:

1. In combination:

a frame defining at least one of a hockey and a soccer goal over a subjacent surface;

a blocking element; and first means cooperating between the blocking element and at least one of the frame and the subjacent surface for moving the blocking element in front of the frame so as to expose and block different parts of the goal as the blocking element is moved, said first means comprising means for moving the blocking element relative to the frame in first and second opposite directions in a first path and in third and fourth opposite directions in a second path.

2. The combination according to claim 1 wherein the frame has a lateral extent and the first means comprises means for moving the blocking element in one of the first and second paths laterally relative to the frame.

3. The combination according to claim 2 wherein the first means comprising means for moving the blocking element in an arcuate path relative to the frame.

4. The combination according to claim 2 wherein the first means comprises means for moving the blocking element in a substantially straight path relative to the frame.

5. The combination according to claim 1 wherein the first means comprises means for moving the blocking element in one of the first and second paths in fore and aft directions relative to the frame.

6. The combination according to claim 1 wherein the blocking element comprises first and second parts and means cooperating between the first and second parts for permitting the first and second parts to be moved relative to each other as the blocking element moves in front of the frame.

7. The combination according to claim 1 wherein the first means comprises means for moving the blocking element randomly in the first and second paths in front of the frame.

8. The combination according to claim 1 including second means for selectively operating the first means from a location remote from the blocking element and frame.

9. The combination according to claim 8 wherein the second means includes a transmitter for sending a control signal, the first means comprises a receiver for the control signal and the first means is operable in response to a signal being sent by the transmitter to the receiver.

10. The combination according to claim 9 wherein the control signal is a radio signal.

11. The combination according to claim 9 wherein there is no hard connection between the transmitter and receiver by which the control signal is sent from the transmitter to the receiver.

12. The combination according to claim 9 wherein the receiver is part of an actuator for moving the blocking element in at least one of the first and second paths in front of the frame.

13. The combination according to claim 9 wherein the blocking element comprises first and second parts and third means cooperating between the first and second parts for permitting the first and second parts to be moved relative to each other as the blocking element moves in front of the goal and the receiver is part of a first actuator for moving the blocking element in front of the frame and a second actuator for moving the first and second blocking element parts relative to each other.

14. The combination according to claim 9 including an ice rink on which the frame is supported and the transmitter is at a location spaced from the ice rink.

15. In combination;

a frame defining at least one of a hockey and a soccer goal over a subjacent surface:

a blocking element; and first means for moving the blocking element in front of the frame so as to expose and block different parts of the goal as the blocking element is moved, said first means comprising means for moving the blocking element back and forth in two different paths in front of and relative to the frame, wherein the first means comprises means for moving the blocking element in pivoting movement about a vertically extending axis relative to the frame in one of the first and second paths.

16. In combination:

a frame defining at least one of a hockey and soccer goal over a subjacent surface;

a blocking element; and first means cooperating between the blocking element and at least one of the frame and the subjacent surface for moving the blocking element in front of the frame so as to expose and block different parts of the goal as the blocking element is moved, said first means comprising means for guidingly translating the blocking element in a fore and aft direction relative to the frame.

17. A method of simulating a goalkeeper, said method comprising the steps of:

providing a frame defining at least one of a hockey and soccer goal over a subjacent surface;

providing a blocking element to simulate a goalkeeper in front of the frame;

guiding movement of the blocking element selectively in a) first and second opposite directions in a first predetermined path relative to the frame and b) third and fourth opposite directions in a second predetermined path relative to the frame to thereby expose and block different parts of the goal.

* * * * *